US005192897A

United States Patent [19]

Vossough et al.

[11] Patent Number: 5,192,897

[45] Date of Patent: Mar. 9, 1993

[54] ELECTRONIC HIGH FREQUENCY CONTROLLED DEVICE FOR OPERATING GAS DISCHARGE LAMPS

[75] Inventors: Eshan Vossough, Dee Why; Mohammed A. Helal, Harbord, both of Australia

[73] Assignee: Minitronics Pty. Ltd., Brookvale, Australia

[21] Appl. No.: 869,867

[22] Filed: Apr. 16, 1992

Related U.S. Application Data

[63] Continuation of Ser. No. 758,167, Sep. 11, 1991, abandoned, which is a continuation of Ser. No. 583,001, Sep. 14, 1990, abandoned, which is a continuation of Ser. No. 453,228, Dec. 14, 1989, abandoned, which is a continuation of Ser. No. 312,411, Feb. 17, 1989, abandoned, which is a continuation of Ser. No. 204,936, Jun. 6, 1988, abandoned, which is a continuation of Ser. No. 99,647, Sep. 23, 1987, abandoned, which is a continuation of Ser. No. 935,114, Nov. 26, 1986, abandoned, which is a continuation of Ser. No. 788,692, Oct. 18, 1985, abandoned, which is a continuation of Ser. No. 541,335, Sep. 13, 1983, abandoned.

[30] Foreign Application Priority Data

Jan. 15, 1982 [AU] Australia ..... PF2301

[51] Int. Cl.[5] ..... H05B 41/36

[52] U.S. Cl. ..... 315/308; 315/DIG.4; 315/DIG. 5; 315/299; 315/219

[58] Field of Search ..... 315/307, 308, DIG. 5, 315/DIG. 7, DIG. 4, DIG. 2, 299, 219, 246, 306, 206, 208, ; 363/37, 101

[56] References Cited

U.S. PATENT DOCUMENTS

| | | | |
|---|---|---|---|
| 3,427,458 | 2/1969 | Parfomak et al. | 250/210 |
| 4,042,856 | 8/1977 | Steigerwald | 315/246 |
| 4,127,893 | 11/1978 | Goepel | 363/37 |
| 4,207,497 | 6/1980 | Capewell et al. | 315/DIG. 4 |
| 4,251,752 | 2/1981 | Stolz | 315/DIG. 7 |
| 4,277,728 | 7/1981 | Stevens | 315/308 |
| 4,356,433 | 10/1982 | Linden | 315/DIG. 7 |
| 4,388,563 | 6/1983 | Hyltin | 315/DIG. 4 |
| 4,414,493 | 11/1983 | Henrich | 315/308 |
| 4,415,839 | 11/1983 | Lesea | 315/308 |
| 4,477,748 | 10/1984 | Grubbs | 315/DIG. 7 |
| 4,523;131 | 6/1985 | Zansky | 315/DIG. 7 |
| 4,585,974 | 4/1986 | Stupp et al. | 315/DIG. 7 |

FOREIGN PATENT DOCUMENTS

| | | |
|---|---|---|
| 041589 | 12/1981 | European Pat. Off. . |
| 1128041 | 4/1962 | Fed. Rep. of Germany . |
| 2828721 | 1/1980 | Fed. Rep. of Germany . |
| 2931794 | 3/1980 | Fed. Rep. of Germany . |
| 2900910 | 7/1980 | Fed. Rep. of Germany . |
| 2928490 | 1/1981 | Fed. Rep. of Germany . |
| 3002435 | 8/1981 | Fed. Rep. of Germany . |
| 2461427 | 1/1981 | France . |

*Primary Examiner*—Paul M. Dzierzynski
*Assistant Examiner*—Ali Neyzari

[57] ABSTRACT

A high frequency electronic ballast which comprises a variable frequency oscillator (1) having its frequency controlled by inputs (10 to 15). The oscillator (1) providing complementary outputs (16, 17) which controls an inverter (4) via a driver circuit (3). The inverter output is a source for a transformer or choke (5) which directly drives a gas discharge lamp (6). In this way the frequency of operation and hence the illumination of the lamp (6) can be changed by changing the driver (3) frequency by direct control (10 to 15) of the oscillator (1) and the lamp voltage is maintained substantially constant while reducing its current flow.

6 Claims, 6 Drawing Sheets

$a = \left(\frac{N_2}{N_1}\right)$; $Zin \doteq R_1 + a^1 R_2 + j\omega(L\ell_1 + a^2 L\ell_2)$

M = MUTUAL COUPLING BETWEEN $N_1$ AND $N_2$

ELECTRONIC HIGH FREQUENCY CONTROLLED DEVICE FOR OPERATING GAS DISCHARGE LAMPS

This application is a continuation of Ser. No. 758,167 filed Sep. 11, 1991, which is a continuation of Ser. No. 583,001, filed Sep. 14, 1990, which is a continuation of Ser. No. 453,228, filed Dec. 14, 1989, which is a continuation of Ser. No. 312,411, filed Feb. 17, 1989, which is a continuation of Ser. No. 204,936, filed Jun. 6, 1988, which is a continuation of Ser. No. 099,647, filed Sep. 23, 1987, which is a continuation of Ser. No. 935,114, filed Nov. 26, 1986, which is a continuation of Ser. No. 788,692, filed Oct. 18, 1985, which is a continuation of Ser. No. 541,335, filed Sep. 13, 1983, all now abandoned.

The present invention relates to ballasts or chokes used for controlling the operation of gas discharge lamps.

Existing ballasts or chokes are formed as coils which prevent harmful voltage surges during lamp operation as well as serving to ignite the gas discharge lamp in a manner which is well understood. Conventional ballasts typically cause a loss of about 20% of the power supplied to drive a lamp and due to their operation at mains frequency (50 Hz) the lamp life is reduced when compared with a higher frequency operation. In addition the 50 Hz operation can provide a stroboscope effect that can lead to rotating machines appearing to be stationary thereby creating a significant safety hazard. Ballast noise can also be an annoying environmental problem.

This invention provides means for operating gas discharge lamps at high frequency with a ready capability for the inclusion of dimming facilities. It is known that by varying the frequency of a constant voltage source connected to the primary of a transformer, the current flowing from the secondary to the load will consequently vary. This principle is adopted in the present invention when applied to gas discharge lamps by using a controlled oscillator driving an inverter through a transformer or choke adapted to limit its own secondary current. This approach is employed for the operation of gas discharge lamps to vary their brightness by varying the frequencyof their operation. The use of a transformer as aforesaid is particularly suited to operation of fluorescent lamps as distinct from High Intensity Gaseous Discharge (HID) lamps. With minor changes, such as the replacement of the transformer by a high frequency choke the same results can be obtained to operate HID lamps.

The present invention consists in a high frequency electronic ballast for gas discharge lamps comprising a controlled oscillator providing two complementary high frequency outputs which are variable in frequency under at least one control input to said oscillator, said complementary outputs inputing to driver means controlling an inverter having a substantially constant duty cycle, the output of said inverter being an a.c. voltage source to a transformer or choke which is adapted to directly drive a gas discharge lamp, said controlled oscillator and driver means being adapted to be supplied from a low voltage d.c. source and said inverter being adapted to be supplied from a high voltage d.c. source.

The present invention will now be described by way of example only with reference to the accompanying drawings, in which:

FIG. 3(*b*) is a schematic circuit diagram of the ballast of FIG. 3(*a*);

FIG. 6(*b*) is a transformer equivalent circuit diagram for the transformer of FIG. 6(*a*); and FIG. 6(*c*) show no load and full load waveforms of the output of the transformer of FIG. 6(*a*).

Figure 1:
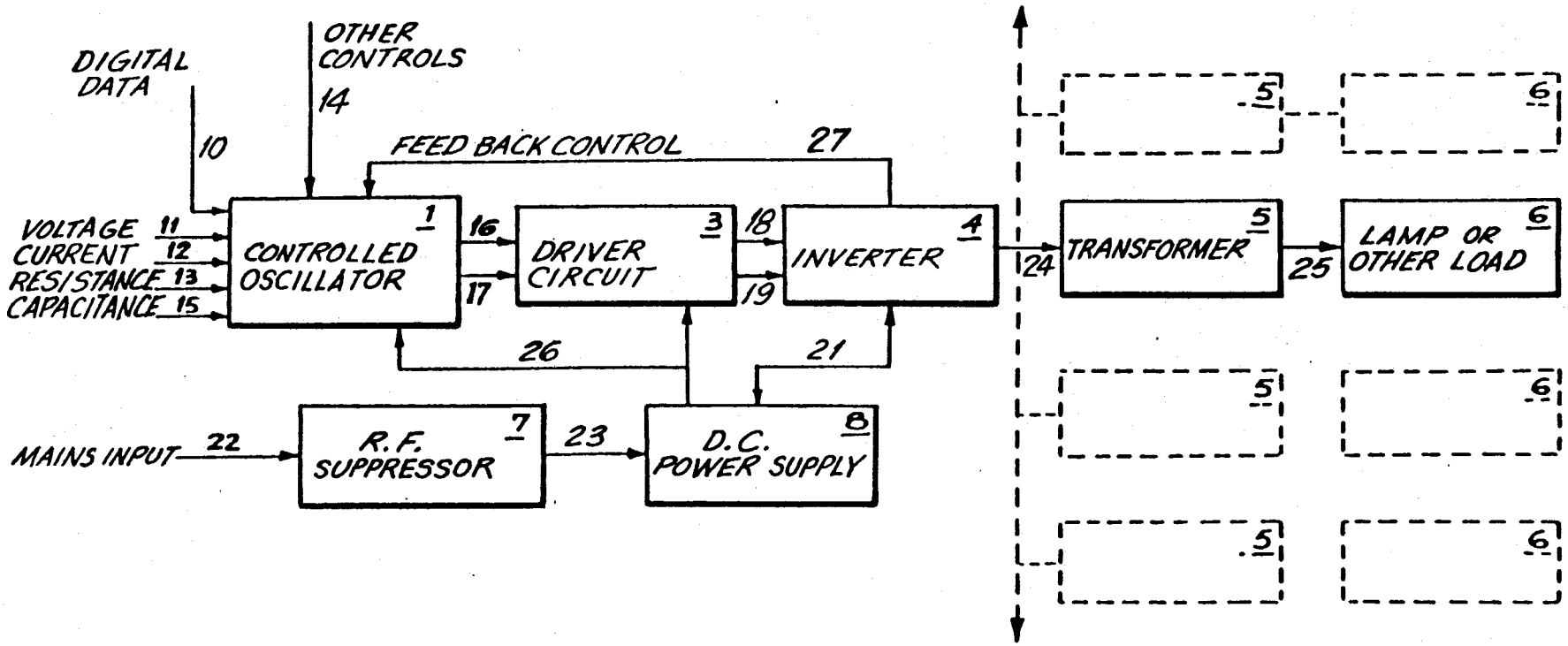
FIG. 1 is a block diagram of an embodiment of the invention.

FIG. 1 shows a block diagram of a preferred form of ballast of the invention and comprises a high frequency controlled oscillator 1 which provides two complementary square wave outputs 16 and 17, which can be varied in frequency through changes to any of controlling inputs 10 to 15 applied to oscillator 1. A driver circuit 3 controls the operation of an inverter 4, the latter having an output 24 which is a source to transformer 5 which directly drives lamp 6 without the necessity of additional current or voltage limiting devices. Power supply 8 produces filtered high DC voltage 21 to inverter 4 and low voltage 26 (with minimum ripple content for minimal lamp flicker and reduction of FM radio frequency interference) to oscillator 1 and driver 3. Mains input supply 22 is suppressed via RF suppression network 7 thus avoiding high frequency feedback into the power lines that otherwise may create T.V. and radio interference. Feedback control 27 is used to regulate the inverter current by adjusting the frequency of the controlled oscillator 1 so as to maintain a constant light output from the lamp during mains voltage fluctuation.

Figure 2:
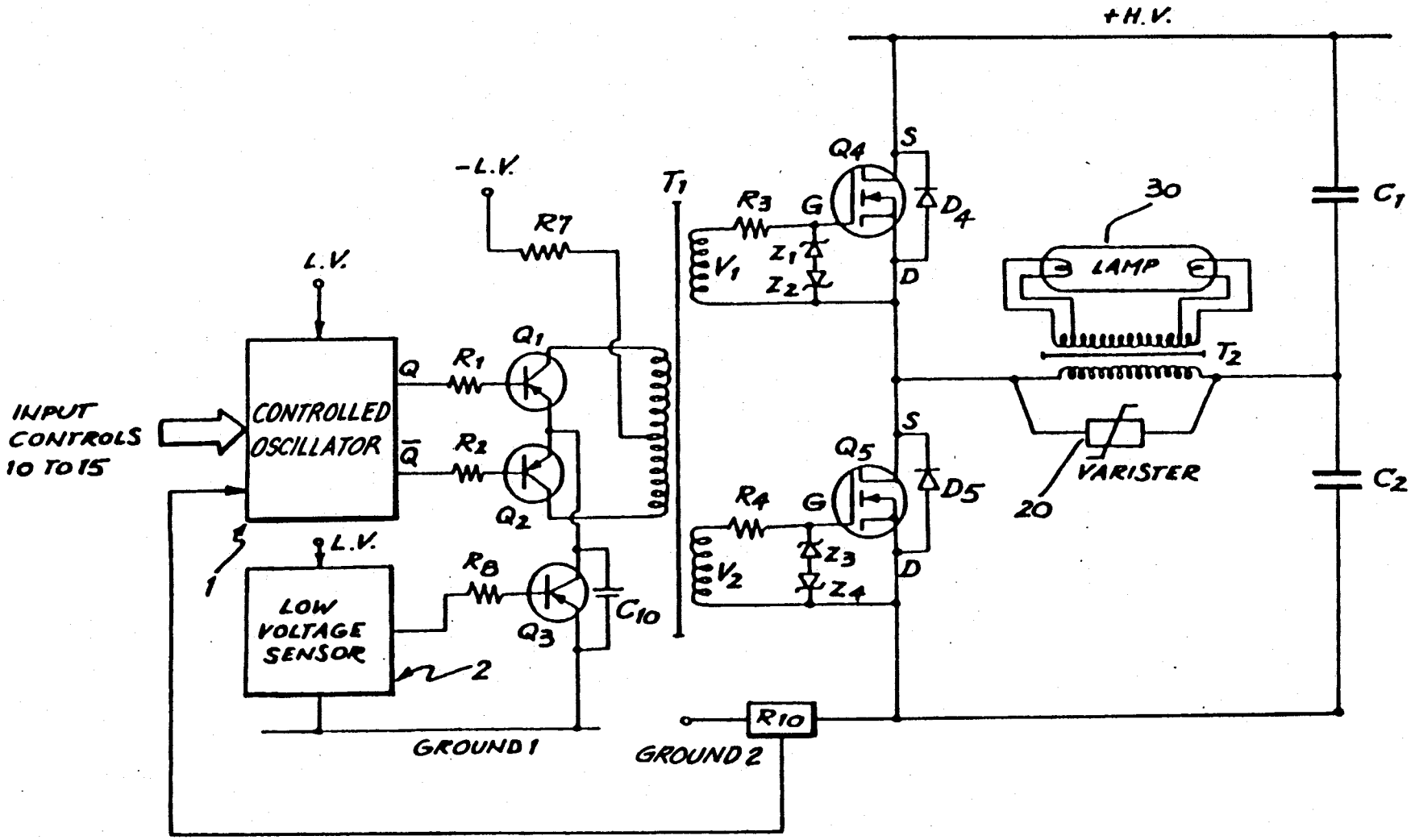
FIG. 2 is a schematic circuit diagram of a ballast in accordance with FIG. 1 for use with fluorescent lamps.

FIG. 2 shows a detailed circuit diagram of relevant components of the block diagram of FIG. 1. The controlled oscillator 1 includes facilities for dimming provided by the input controls 10 to 15. Complementary outputs Q and $\overline{Q}$ drive a push pull circuit consisting of transistors Q1, Q2 and transformer T1. Variations in the low voltage supply can occur during power on, power off or line transients, causing similar variations to the driving voltages V1 and V2 of transistors Q4 and Q5, respectively. Should voltages V1 and V2 drop below the threshold gate voltages of transistors Q4 and Q5, it can cause both to conduct simultaneously causing a circuit failure. To prevent this from happening under such conditions during power up, which there is a small delay associated with the charging of electrolytic filtering capacitor across the low voltage power supply. Low voltage sensor 2 detects such variations in the low voltage line and controls the operation of transistors Q1 and Q2 through transistor Q3 arranged as a series switch which couples the emitters of Q1 and Q2 to the ground of the low voltage rail. Capacitor C10 smoothes out ripples that appear during switching at the emitter Q1 and Q2. The output windings of transformer T1, are arranged to ensure that transistors Q4 and Q5 are never both simultaneously conductive. Zenner diodes Z1, Z2, Z3 and Z4 protect the gates of Q4 and Q5 from high voltage pulses which are coupled via the source gate or drain-gate stray capacitance present in the circuit, as well as any other transients. It is understood of course, that the half bridge inverter of FIG. 2 illustrates a preferred embodiment only; a full bridge or a push pull inverter with bi-polar or mosfet switching transistors can also be employed. Resistances R3, R4 and R7 in conjunction with the gate-source junction capacitances of transistors Q4 and Q5 are chosen so that V1 and V2 have a slew rate suitable for driving the power mosfets.

Output from the inverter is directly connected to a transformer T2 and a varistor 20 to protect transistors Q4 and Q5 from inductive high voltage spikes on the primary when lamp 30 is removed or installed while the circuit is operating, or possible short circuiting of the transformer secondary or other similar factors. Current sensing resistor R10 is used to regulate the inverter current by adjusting the frequency of the controlled oscillator and to maintain a constant light output from the lamp during mains voltage fluctuation. It must, however, be understood that the controlled oscillator 1 could consist of a micro-processor in which case the low voltage sensor 2 could be incorporated into the micro-processor rather than be represented as a separate entity.

Ballasts in accordance with the present invention may incorporate more than one transformer to allow for multiple lamp operation from the same system.

Figure 3A:
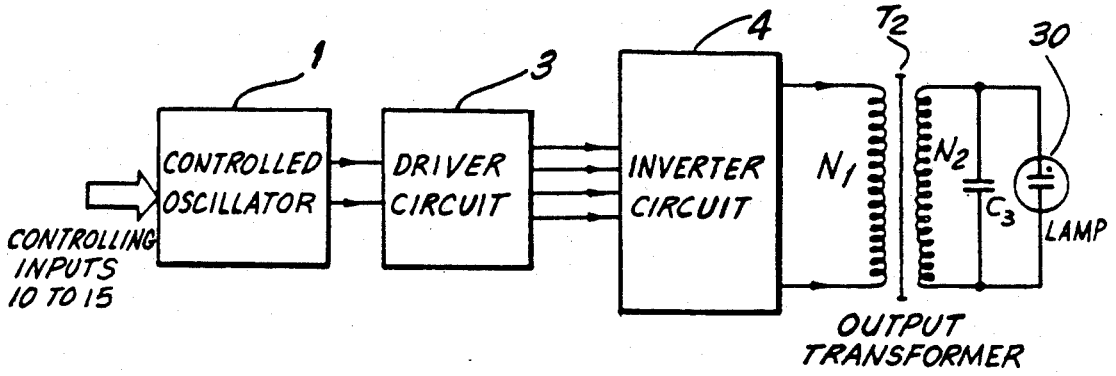
FIG. 3(*a*) is a block diagram of a ballast in accordance with the present invention for use with a HID lamp.
Figure 3B:
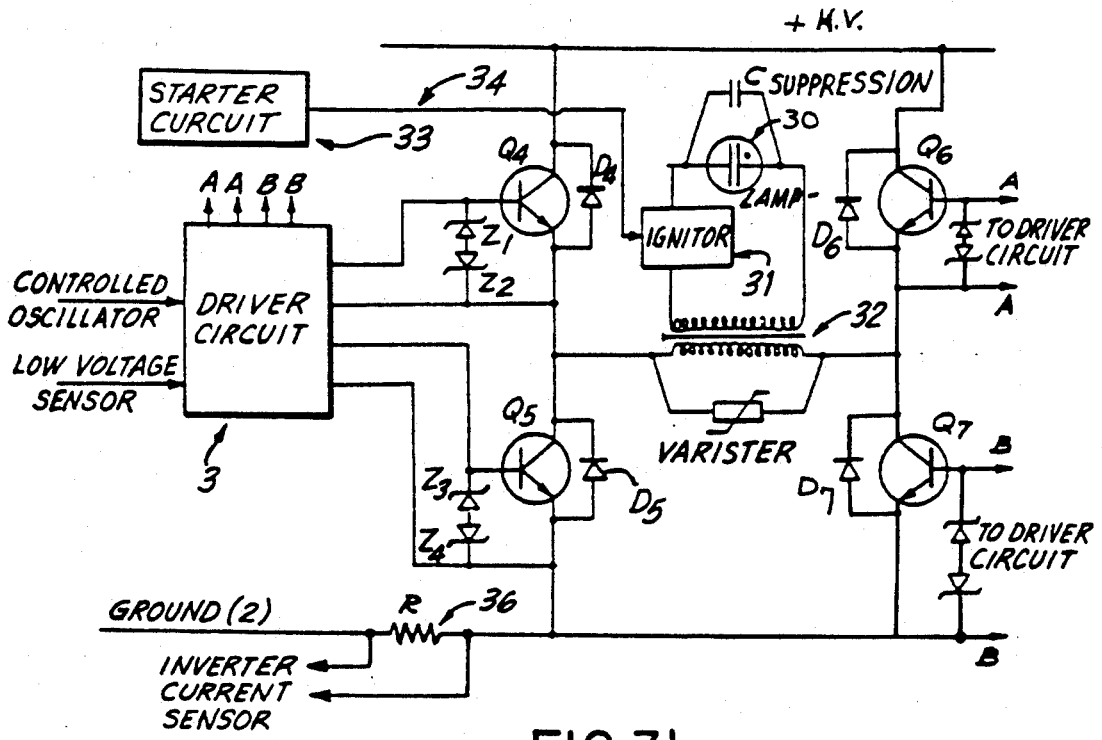

FIG. 3(*a*) shows how the ballast can be readily adapted to operate a HID lamp. The addition of capacitor C3 helps to increase the overshoot of the secondary of output transformer T2 and thereby assist striking of the lamp 30, such is the case for a low pressure sodium lamp.

In FIG. 3(*b*) the addition of an ignitor circuit 31 to the output of transformer 32 can be used for HID Lamps. A starter circuit 33 initiates ignition of the lamp 30. Once the lamp 30 is ignited, the ignitor 31 is cut off from the circuitry. It should also be understood that the starter circuit can be integrated in a micro-processor.

Figure 4:
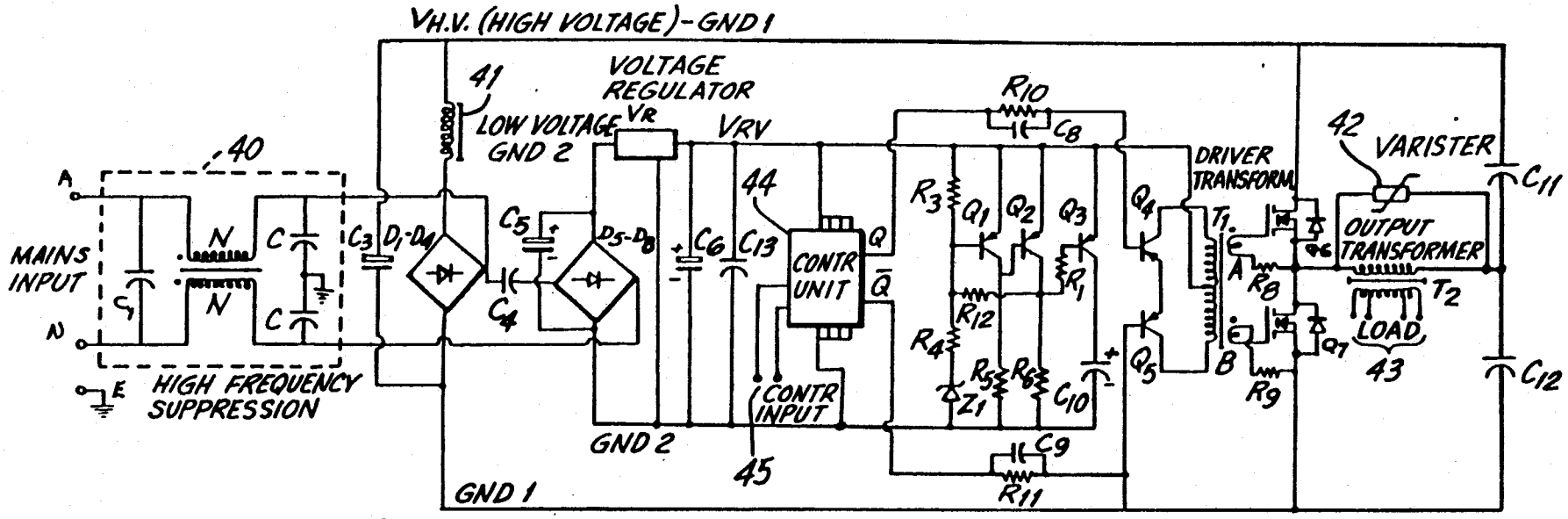
FIG. 4 is a circuit diagram of a preferred form of ballast of this invention for use with a fluorescent lamp.

Referring to FIG. 4 which is a circuit diagram of a preferred form of ballast of this invention for driving a fluroescent lamp.

The mains input is suppressed against high-frequency radio interfering currents, which emanate from the high-frequency operation of the ballast, into the input mains lines. The R.F. suppressor 40 comprises a ring core, of a highly lossy nature, wound with two sets of wires of equal numbers of turns. The currents flowing in these wires is such that their relative fluxes oppose each other, hence no response is obtained from a 50 Hz mains current flowing into the system. Only the high-frequency signals will be filtered via the L-C low pass filtering action of the suppressor.

Diodes D1–D4 rectify the mains input resulting in a full wave output. A small choke 41 limits surge currents flowing into the electrolytic filtering capacitor C3. Resulting output d.c. voltage $V_{H.V.}$ with respect to GND1 will have an acceptable ripple content so as to produce a minimal flicker on the light output from the lamp.

The output power stage consists of transistors Q6–Q7, capacitors C11–C12 and output transformer T2, configured as a "half-bridge system". A shunt metal oxide varister 42 across the transformer T2 will limit any transients or spikes due to the inductive nature of transfomer T2, resulting from mistreating of the load 43, due to momentary shorting of output transformer T2 or a faulty lamp 43. The switching elements Q6 and Q7 can be power bipolar or MOS-FET transistors.

DRIVER SECTION

The mains input is reduced using C4, rectified using bridge diodes D5–D8, filtered using capacitor C5 and regulated with a voltage regulator VR. Regulated voltage VRV, with respect to GND2, will supply the control unit 44 and driver circuitry and other optional circuits included.

Control unit 44 provides two complementary logical outputs Q and $\overline{Q}$ which can be varied in frequency via a set of "Control Inputs" 45. Control Unit 44 can be a micro-processor, CMOS I.C. or equivalent device.

Complementary outputs Q, $\overline{Q}$ drive a push-pull arrangement which consists of transistors Q4–Q5 and transformer T1, via resistance capacitance couplings $R_{10}$, C8 and $R_{11}$, C9, respectively. Two sets of secondary windings on transformer T1 provide two complementary outputs A and B which drive transistors Q6 and Q7 via limiting resistors R8 and R9, respectively.

The push-pull arrangement can be activated or deactivated via a safe-guard circuit consisting of transistors Q1, Q2 and Q3. This safe-guard circuit de-activates the push-pull circuit, transistors Q4–Q5. The reason for using this circuit is that should the main voltage drop below a safe value due to line voltage variation or during power-up and power-down conditions, thereby reducing A and B voltages on the secondary of transformer T1 below the minimum threshold voltage level of transistors Q6 and Q7. This will cause transistors Q6 and Q7 to enter their linear region of operation and short-circuit the high-voltage supply; damage to Q6–Q7 may arise, as a result.

The circuit operation can be explained as follows: consider when the supply is switched ON VRV will begin to increase while C6 charges up. Zener diode Z1 will conduct at a specified VRV, thus turning transistor Q1 ON via resistor R4, while transistor Q2 turns OFF and transistor Q3 tuns ON via R7 and R6. Some hysteresis is introduced into the circuit via resistor R12 as follows: With Q2, OFF, the voltage at its collector is pulled "HIGH", with respect to GND2. Additional current is fed to the base of Q1 using R12 to drive it further into saturation. In order for Q1 to turn OFF again, voltage VRV must drop by a margin of a few volts irrespective of the action of the reference zener diode Z1. Hence, any reduction in VRV due to the activation of the push-pull driver will not cause further deactivation of the system and will avoid spurious oscillation.

DIMMING

Figure 5:
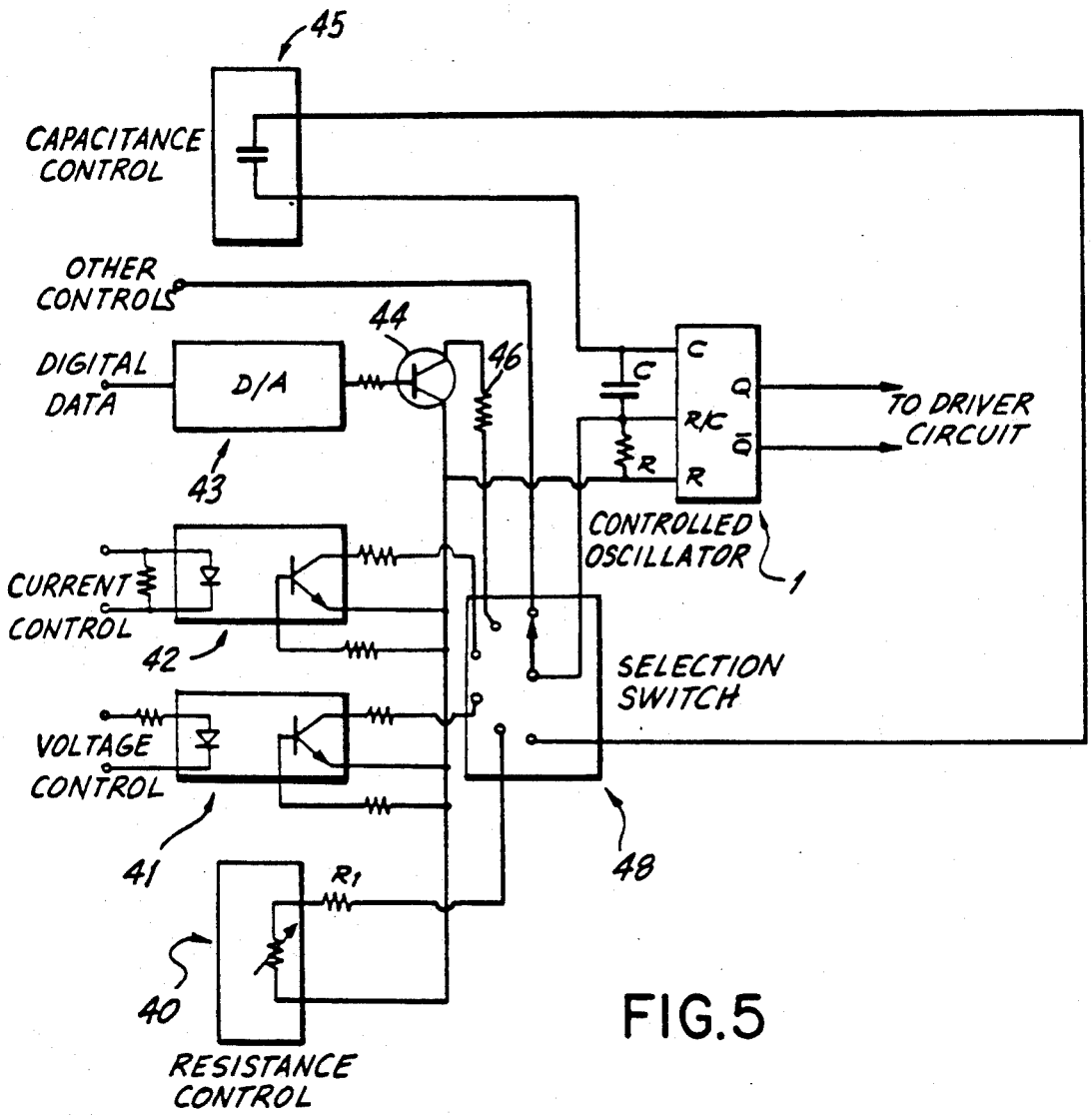
FIG. 5 is a schematic circuit diagram of a controlled oscillator for use in a ballast of the present invention.

FIG. 5 shows an arrangement of FIG. 1 for the control of oscillator 1 which consists of an astable multivibrator the frequency of which depends on the external resistor R and the external capacitor C. Each of these parts can be varied by a shunt resistor fitted externally; i.e. a variable resistor 40 or a mosfet transistor 44 in series with resistor 46 or optocouplers 41 and 42. A selection switch 48 used is only by way of an example, but other means are also possible.

The frequency of the oscillator 1 may depend on resistance, capacitance or digital data as described in relation to FIG. 5. A photo resistor may be used for automatic dimming control with ambient light being monitored at a suitable location in the vicinity of the lamp fitting. Each lighting unit may operate with a separate light cell, or with a common cell, controlling a group of ballasts. Adjustments are possible with each unit to satisfy the level of luminance required for a particular area and can be carried out on site. The unit can be set at the factory at a specified light output. Maximum light output being related to the minimum frequency and vice versa.

Independently operating ballasts, used with separate photocells provide a more uniform light distribution and the cost of an extra photo-cell is a small fraction of the total cost of the unit.

Dimming is applicable to the full-bridge, half-bridge inverters and can be provided for fluorescent and HID lamps.

The oscillator 1 may be an astable integrated circuit with complementary outputs Q and $\overline{Q}$ or a micro-processor.

The frequency variation of inverter 4 may be a direct function of resistance, therefore a variable resistor 40, or a potentiometer, a photo-resistor or an opto-coupler, etc., may be used for effective dimming control. Alternatively, the frequency may be a direct function of capacitance 45 and the dimming being controlled by a variable capacitor such as a capacitive transducer, or a microphone, etc., again both above type functions, resistance and capacitance can be used simultaneously provided that individual function controls are established. In practice, it is easier to alter the resistor for remote control operation than be troubled by the consequences of capacitive operation subjected to long distance transmission lines. In addition when an opto coupler is used, isolation against high voltage spikes is obtained.

Minimum frequency is determined by the R-C time constant, relating to the maximum light output. Maximum frequency in the case of resistance control is determined by resistor R1 and the external control resistor 40, in parallel with resistor R relating to the minimum light output, as in FIG. 5.

MICRO-PROCESSOR SYSTEM

When the size of the ballast, due to the increase in the number of components arising from increase in the demand for various operations, such as current control, light control, over-load detection, high-voltage protection, etc., which reflect considerably in the long term reliable running of the ballast, the Micro-processor becomes a necessity.

The overall procedure for testing various functions, such as mentioned previously, will be included in the software. The actual operation being carried out via the on-board ports of the processor, either directly or via few external components. Control of the processor operation will reflect partially in the way the software is packaged, and will be critical to the speed of the processor, as to be able to provide the necessary signals to run the inverter, and simultaneously monitor all the control input and acquire parameters which determine the required status of the ballast. This is basically summarised as how should the inverter function if (i) load is short-circuited, (ii) load current exceeds a safe limit, (iii) supply voltage falls below a critical level, or exceeds a critical level, (iv) mis-use of the load, causing severe transients to the inverter, (v) zero-detector at which the inverter is turned ON, (vi) soft-start operation to minimize burden on the filaments, etc. Input control to the micro-processor may be in analogue or digital form. Analogue information from a photo-cell, potentiometer or a small voltage are converted to digital form via an on-board A/D converter for analysis.

Logical data may be serial or parallel, and can be received via an on-board port before diagnosis. Using serial communication between ballasts a central control system may be utilized in controlling a large number of ballasts to perform similarly or even differently according to their allocated duties. Each ballast, or group of ballasts, can be identified by a serial address, which when received will be translated to identify which ballast is required to perform the required duties. Any ballast may be required to perform at its own phase or remotely when addressed externally. Manual operation is also possible by simple use of a switch to cut the photo-cell out and switch in a pentiometer.

Software package: This section will demonstrate one possible software approach, using a micro-processor with on board RAM, a programmable timer, digital and analogue I/O ports and ROM, containing the required user's software.

The timer is used to interrupt the micro-processor at equal intervals, during which the states of Q and $\overline{Q}$, outputs to the INVERTER driver, are changed. These intervals will determine the operating frequency of the ballast and can be varied via a time-constant produced by the main program.

Upon return from the interrupt routine the processor will resume the process of checking various input control signals, as to adjust the timer time-constant for dimming, if required, or disable the inverter should it operate at a critical mains voltage, until it is interrupted again. This process becomes essential if the micro-processor is a slow one. As a result, the period required to process the whole monitor may far exceed the actual frequency of operation. This means that the processor is interrupted many times during the running of the monitor, hence a small delay is required for the processor to respond to variation in the light, or other commands for which it is programmed to analyse.

OUTPUT TRANSFORMER DESIGN (FLUORESCENT LAMPS)

Figure 6A:
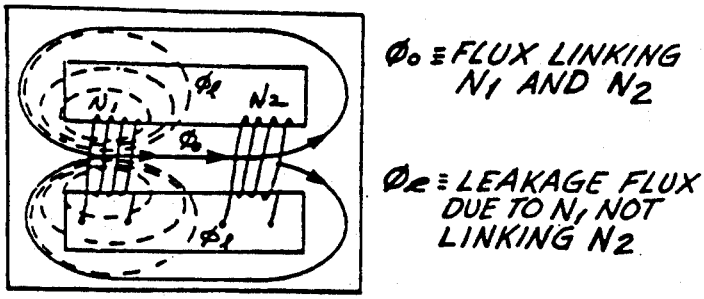
FIG. 6(*a*) shows the winding configuration of an E-core transformer for use as an output transformer in a ballast for fluorescent lamps.
Figure 6B:
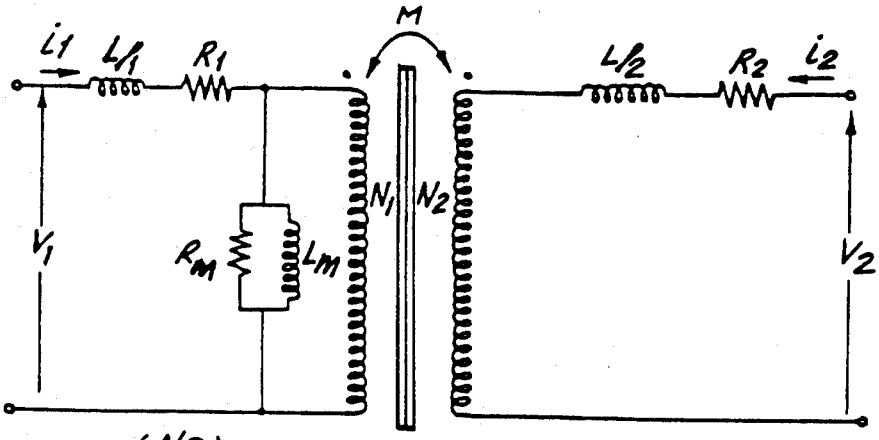
Figure 6C:
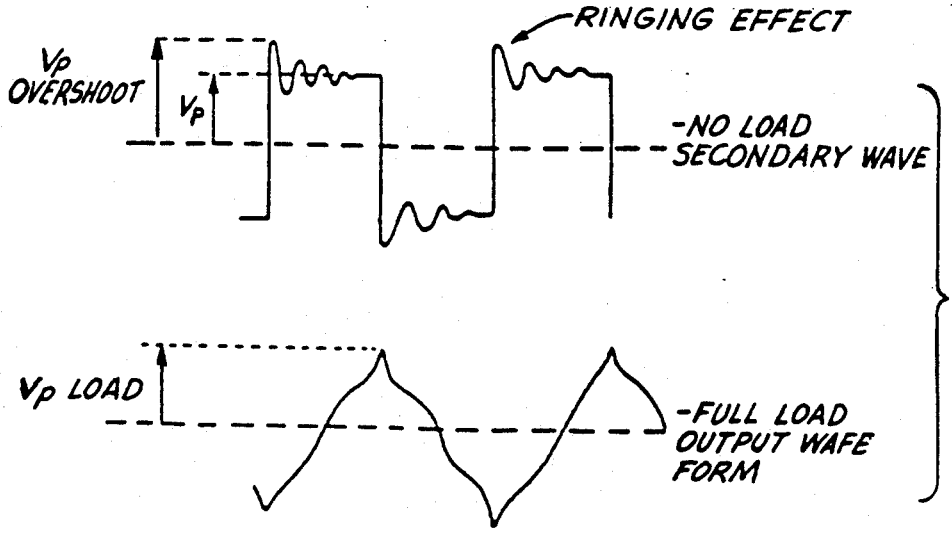

With reference to FIGS. 6(*a*), (*b*) and (*c*) the output transformer T2 of FIG. 2 (FIG. 6(*a*)) consists of an E-Core transformer. The primary winding N1 is wound separately from the secondary winding, N2 on far ends of the center leg. In this way, loose coupling $\phi_o$ is obtained between the primary and the secondary windings, N1, N2, attributed to a small co-efficient of coupling. Referring to FIG. 6(*b*), the primary can be represented by a resistive component R1, leakage inductive components Ll1, the shunt magnetizing components Rm, Lm, which are usually very large and can be ignored, and the number of turns N1 of the primary. The secondary can be represented by the number of turns N2, a series winding resistance R2 and leakage inductance Ll2. This winding configuration of the transformer allows for large limiting inductances Ll1 and Ll2 which are responsible for limiting the power into the load on the transformer secondary, by limiting the load current. This technique eliminates the need for a current-limiting choke on the transformer secondary, preventing additional losses. Large secondary inductance also results in considerable amounts of ringing on the secondary waveform, with overshoot of the order of 2 to 3 times the peak of no load steady state output voltage. This ringing effect helps striking of the fluorescent tube, or certain discharge lamps used on the secondary. When the lamp ignites, power into the lamps, and filaments, is reduced simultaneously. The apparent advantage of this characteristic is reflected in the control of the filament power, such that, when the lamp is "OFF" the RMS power into the filaments is adequate for heating of the filament, and is approximately equal to:

$$P\,\text{fil (OFF)} = (V\,\text{fil} \times I\,\text{fil}) = \left(\frac{N\,\text{fil}}{Np}\right) \times V\,\text{Primary}\,(RMS) \times I\,\text{fil}\,(RMS)$$

(Np=Primary turns)
(Nfil=Filament turns)

After Lamp Strikes, the rms current into the filaments will be reduced to a value (I'fil<I fil) with reduced burden on the filaments:

$$P\,\text{fil (ON)} = K * 0.578\left(\frac{N\,\text{fil}}{Np}\right) Vp \times I\,\text{fil}\,(RMS)$$

Where K=correction factor for the reduction in the peak amplitude of the triangular waveform from the peak steady-state square input, Vp. (FIG. 6(*c*)); K is less than unity and depends on the voltage across the lamp.

The winding ratio for the primary and the secondary determines the secondary voltage, required to breakdown the gases in the lamp. However, the required power into the load is determined by the number of primary turns, and the frequency at which the transformer is operating. This unique characteristic arising from the inductive nature of the transformer input is utilized in dimming, whereby, increasing the frequency of the input source will result in the reduction of the load power.

However, there will be no change on the secondary voltage, other than a small decrease due to the capacitive nature of the load, which results in no significant change on the filament or tube voltage, at any dimming level, which would further provide that the tube will strike at its minimum dimmed level in the same way as its full light level with little difference in striking time. The power delivered to the filaments varies little with the change in the operating frequency, since the RMS voltage on the filaments do not change while starting.

Where output transformers are not used, chokes can be employed for current limiting. For HID lamps secondary ringing helps reduce the unwanted reignition time of Mercury vapour, sodium or similar lamps during a temporary power failure. A suitable value capacitor across the lamp would maximize these ringings to a suitable level. This property can be employed for low-pressure sodium lamp — where it requires a voltage in excess of 600 v in order to strike the lamp which is readily achieved by the stored energy in the chokes; this consideration is also applicable to E-Transformers.

By use of the present invention there are significant energy savings and the life of lamps will be increased. This will arise because the higher frequency of operation will increase efficiency by an estimated 10%. Consequently, the power input can be reduced for a given light intensity, thus enhancing lamp life. A side benefit of higher frequency operation is that the undesirable flicker of discharge lamps will be eliminated. This has an important safety advantage in that the 50 Hz stroboscopic effect that can lead to rotating machines appearing to be stationary will also be eliminated, as the lamp frequency is about 20 KHz — well above that of mechanical devices. In addition at that frequency the electronic ballast is noise free.

Lamps will be able to run at or near unit power factor. This means that the usual corrective capacitors that have to be installed to balance the inductance of the ballast can be eliminated. For a given power level the current required to operate the lamps is thereby reduced, and the sizes of wires, terminals etc. in an installation can be reduced.

A further advantage of the increased efficiency of the lamps is that the heating effect on the lighted space can be reduced. As an example consider an office with ten forty watt lamps each dissipating ten watts in the ballast. The heating effect is 100 watts — a significant extra load for a typical 650 watt of 1000 watt air conditioner to handle.

The ballast can be used for a wide range of loads varying from low power to high power gas filled devices. Instant starting of fluorescent tubes with a better lumen to output power ratio also is obtained.

We claim:

1. A high frequency electronic ballast for gas discharge lamps comprising a controlled oscillator providing two complementary high frequency outputs which are variable in frequency under at least one control input to said oscillator, said complementary outputs inputing to driver means which in turn provides an input to a non-resonant inverter, said inverter having a substantially constant duty cycle, said inverter having a frequency variable as a function of the controlled oscillator frequency, the output of said inverter being a source to a transformer or choke which enables the inverter to directly drive a gas discharge lamp, said controlled oscillator and driver means being adapted to be supplied from a low d.c. voltage source and said inverter being adapted to be supplied from a high d.c. voltage source, and wherein dimming control is provided by said at least one control input to the oscillator to vary the frequency of the oscillator and thereby vary the frequency of the inverter and the light output of the gas discharge lamp.

2. A high frequency electronic ballast as claimed in claim 1 wherein said transformer is an E-core transformer with primary and secondary windings on opposite ends of the centre leg.

3. A high frequency electronic ballast as claimed in claim 1, wherein said driver means comprises a push pull transistor circuit transformer coupled to said inverter.

4. A high frequency electronic ballast as claimed in claim 3 wherein the push pull circuit is activated or de-activated by a safe-guard circuit which de-activates the push pull circuit when the main voltage drops below a predetermined level due to live voltage variation or power-up and power-down of said ballast.

5. A high frequency electronic ballast as claimed in claim 4, wherein the safe-guard circuit comprises a low voltage sensor coupled via a transistor to the emitters of said push pull transistors and to the ground of the low voltage rail.

6. A high frequency electronic ballast as claimed in claim 1, wherein the low voltage and high voltage sources are derived from a mains A.C. input via a radio frequency suppressor.

* * * * *